US007766145B1

(12) United States Patent
Chang

(10) Patent No.: US 7,766,145 B1
(45) Date of Patent: Aug. 3, 2010

(54) PRODUCT TRANSFER ASSEMBLY FOR A VENDING MACHINE

(76) Inventor: Kil Jae Chang, T.PiCo, Korea Co., Ltd., 321-37 Suksu, 2 Dong, Anyang City, Kyungkido (KR)

( * ) Notice: Subject to any disclaimer, the term of this patent is extended or adjusted under 35 U.S.C. 154(b) by 166 days.

(21) Appl. No.: 11/977,907

(22) Filed: Oct. 26, 2007

Related U.S. Application Data

(60) Provisional application No. 60/998,149, filed on Oct. 9, 2007.

(51) Int. Cl.
*A24F 15/04* (2006.01)
*A47F 1/04* (2006.01)
*G07F 11/00* (2006.01)

(52) U.S. Cl. ..... 193/13; 221/24; 221/155; 221/194

(58) Field of Classification Search ..... 221/24, 221/155, 194
See application file for complete search history.

(56) References Cited

U.S. PATENT DOCUMENTS

| | | | | |
|---|---|---|---|---|
| 433,736 | A | 8/1890 | Lockwood | |
| 517,071 | A | 3/1894 | Russell | |
| 3,077,254 | A | 2/1963 | Goldfarb | |
| 4,360,204 | A * | 11/1982 | Karr | 473/137 |
| 5,452,822 | A | 9/1995 | Haymond | |
| 5,782,378 | A | 7/1998 | Hart et al. | |
| 5,788,115 | A | 8/1998 | Halliburton | |
| 5,833,117 | A | 11/1998 | Kovens et al. | |
| 5,897,022 | A | 4/1999 | Mann | |
| 6,056,151 | A | 5/2000 | Peery et al. | |
| 6,520,374 | B1 | 2/2003 | Chang | |
| 6,536,625 | B2 * | 3/2003 | Chang | 221/132 |

* cited by examiner

*Primary Examiner*—Gene Crawford
*Assistant Examiner*—Yolanda Cumbess
(74) *Attorney, Agent, or Firm*—John R. Flanagan; Ethan A. McGrath

(57) ABSTRACT

A product transfer assembly includes separate transfer segments mounted in a vending machine such that they are disposed in spaced relationship above one another. Each transfer segment has a ramp of helical shape with an exit end and an entrance end spaced above the exit end such that the ramps of the transfer segments together define a path of travel taken by a product item down and in contact with the ramps which includes spaced apart portions helical in shape and reversing the direction of travel of the product item, relative to a generally vertical reference axis, going from one portion to the next portion of the path. Entrance and exit ends of each ramp are angularly displaced from corresponding ends of an adjacent ramp such that the object free-falls out of contact with any ramp between the exit and entrances ends of adjacent ramps.

9 Claims, 4 Drawing Sheets

PRODUCT TRANSFER ASSEMBLY FOR A VENDING MACHINE

This patent application claims the benefit of U.S. provisional application No. 60/998,149 filed Oct. 9, 2007.

BACKGROUND OF THE INVENTION

The present invention generally relates to vending machines and, more particularly, is concerned with a product transfer assembly of modified zigzag shape for a vending machine.

Products, such as gumballs and plastic capsules or balls containing candy or other novelties inside, are well-known and universally popular with consumers. Typically these products are sold in bulk vendors commonly referred to as vending machines. These vending machines generally include a product reservoir, a coin-actuated dispensing mechanism and a product discharge structure all designed to cooperate in serially dispensing an item or items of the product from the reservoir down through the dispensing mechanism to an external discharge location via the product discharge structure.

Historically, these vending machines were typically designed only to display and dispense the product. Other than by being painted in bright colors, the typical vending machine was not designed to attract consumers by employing unconventional techniques, such as incorporating some unexpected action or movement of the items of the product during its dispensing from the machine where such movement was visible and had entertainment value to the consumer. Over recent years, however, consumers have increasingly wanted something more, such as to be entertained, after depositing a coin in a vending machine to initiate a dispensing cycle. So new approaches have been devised by vending machine designers to overcome this historical practice in order to draw more attention to vending machines to encourage their use.

Some representative examples in the prior art of vending machines that have adopted the approach of adding entertainment value to their machines are found in U.S. Pat. No. 3,077,254 to Goldfarb (this early machine might be viewed as an except to the above-described historical practice in that it did incorporate entertainment value in its dispensing structure), U.S. Pat. No. 5,452,822 to Haymond, U.S. Pat. No. 5,782,378 to Hart et al., U.S. Pat. No. 5,788,115 to Halliburton, U.S. Pat. No. 5,833,117 to Kovens et al., U.S. Pat. No. 5,897,022 to Mann, U.S. Pat. No. 6,056,151 to Peery et al., and U.S. Pat. No. 6,520,274 to Chang. Most of these vending machines, except for Chang, employ structures in the form of spiral, serpentine and zigzag shaped tracks down which the items of the products roll or slide due to gravity from an upper dispensing mechanism to a lower discharge location where the product can be removed by a consumer. While the structures of these prior art patents appear to be mostly satisfactory in use for the specific purpose for which they were designed, such as to provide an excitement aspect or entertainment value to product item travel along a discharge path, the configuration and arrangements of some of these structures would appear to occasionally allow product items to be thrown off their tracks and thus dislocated and not reach the lower discharge location where product items can be removed by consumers. Others do not seem likely to capture the attention of consumers sufficiently long enough to encourage them to make repeated use of the vending machine.

Consequently, a need still exists for an innovation which will provide a solution to the aforementioned problems in the art without introducing any new problems in place thereof.

SUMMARY OF THE INVENTION

The present invention provides a product transfer assembly having a modified zigzag shape designed to satisfy the aforementioned need. The product transfer assembly of the present invention seeks to provide improved control of downward travel of product items upon the product transfer assembly so as to reduce dislocations therefrom. At the same time, the product transfer assembly of the present invention achieves an enhanced excitement value in light of its incorporation of the modified zigzag shape for the path of travel of the product items which will attract and hold the attention of consumers and encourage them to make repetitive use of the vending machine. The zigzag shape of the path of travel of the product item is characterized herein as being "modified" in the sense that the shapes of the portions of the path of travel of the product item over the product transfer assembly are substantially helical instead of substantially linear which the term "zigzag" alone would ordinarily imply. Also, the helical shaped portions of the path are joined at the end of one portion to the beginning of the next by travel of the product item along a steep path portion of free-fall descending trajectory followed by a short ascending travel accompanied by slowing and then turning of the product item to reverse its direction.

Accordingly, the present invention is directed to a product transfer assembly for use in a vending machine which comprises: (a) a plurality of separate transfer segments adapted to be mounted in a vending machine such that the transfer segments are disposed in a spaced relationship above one another; and (b) each of the transfer segments having a ramp of substantially helical shape with an exit end and an entrance end spaced above the exit end such that the ramps of the transfer segments together define a path of travel taken by a product item downward and in contact with the ramps which includes a plurality of spaced apart portions substantially helical in shape and reversing the direction of travel of the product item relative to a generally vertical reference axis going from one portion to the next portion of the path. Furthermore, the entrance and exit ends of each ramp are angularly displaced from the entrance and exit ends of an adjacent ramp such that the product item will leave the exit end of an upper one of the transfer segments, free-fall along a descending trajectory out of contact with the ramps of any transfer segments and land on an intermediate area of the ramp of a lower one of the transfer segments which is spaced from and disposed between the entrance and exit ends of the lower one of the transfer segments such that the product item will slow by traveling a short distance up the ramp of the lower one of the transfer segments and make a turn while in contact with the intermediate area of the ramp of the lower one of the transfer segments in order to reverse the direction of travel of the object relative to the generally vertical reference axis.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
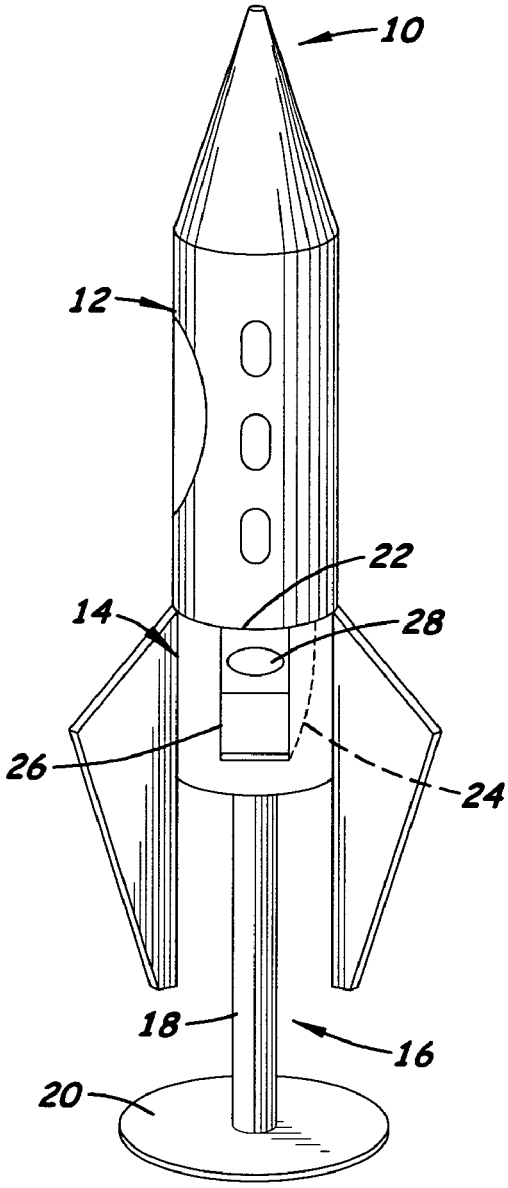
Fig. 1 (PRIOR ART)
FIG. 1 is an elevational view of a prior art vending machine simulating the appearance of a rocket but not having an observable product delivery or discharge structure.
Figure 2:
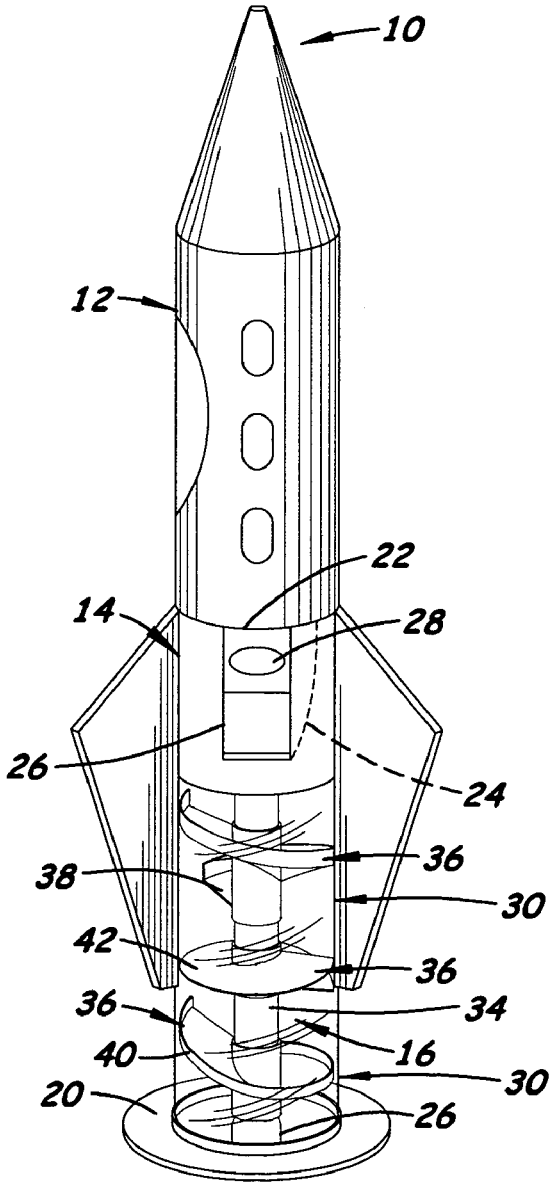
FIG. 2 is an elevational view of the machine of FIG. 1 but now incorporating the modified zigzag product transfer assembly of the present invention.

Referring to the drawings and particularly to FIG. 1, there is generally illustrated an exemplary embodiment of a prior art vending machine 10 in which the present invention may be advantageously incorporated as seen in FIG. 2. The prior art vending machine 10 basically includes a reservoir 12 for holding items of the product in a bulk form and a housing 14 supporting the reservoir 12 and, in turn, mounted on a stand 16 having an elongated tubular support member 18 and a flat base 20 fixedly attached to a lower end of the tubular support member 18 so as to maintain it in an upright orientation. The prior art vending machine 10 also includes a coin-actuated dispensing mechanism 22 mounted to and within the housing 14 and thus disposed below and in communication with the reservoir 12, and a discharge chute structure 24 mounted inside the housing 14 which communicates with the dispensing mechanism 22 and routes one or more product items to an exterior dispensing location 26 on the housing 14. The dispensing mechanism 22 has an exterior handle 28 which is grasped by a consumer and turned to cause movement of internal elements of the dispensing mechanism 22 through one dispensing cycle for each time a coin (or a combination of coins) is deposited in the dispensing mechanism 22 to thereby cause the delivery or transfer of the one or more product items to the exterior location 26 via the internal discharge chute structure 24.

The prior art vending machine 10 which has these basic components can take on various external designs. The one illustrated in FIG. 1 just happens to be designed to incorporate fins to simulate the appearance of a rocket which has the positive effect of attracting consumers to it. It should be apparent that the subject matter of the present invention could be incorporated advantageously into other prior art vending machines having alternative external appearances or designs. One such vending machine is shown in the inventor's U.S. Pat. No. 6,520,374 in which the present invention can readily be employed in a manner similar to that of the curvy slide delivery chute shown and described therein. Also, the product of the vending machine 10 can be various things, such as gumballs, lollipops, or plastic balls which contain an item of candy or a novelty.

Referring now to FIG. 2, there is illustrated a product transfer assembly, generally designated 30, of the present invention having an overall a modified zigzag configuration and incorporated by the prior art vending machine 10 of FIG. 2. The product transfer assembly 30, due to its appearance, may also be characterized as a slide assembly. The product transfer assembly 30 may be incorporated in the vending machine 10 in an overall manner similar to that of the curvy slide delivery chute as shown and described in the inventor's above-cited patent in order to now transfer the one or more items of product to a modified exterior dispensing location 26 on the base 20 of the vending machine 10, instead of on the housing 14 as in the case of the prior art arrangement shown in FIG. 1. It should be understood that due to the incorporation of the product transfer assembly 30, the housing 14 and base 20 of the vending machine 10 would be correspondingly modified to accommodate the changes introduced into the vending machine 10 by the employment of the product transfer assembly 30 as the means to transfer items of product instead of the discharge chute structure 24.

Figure 3:
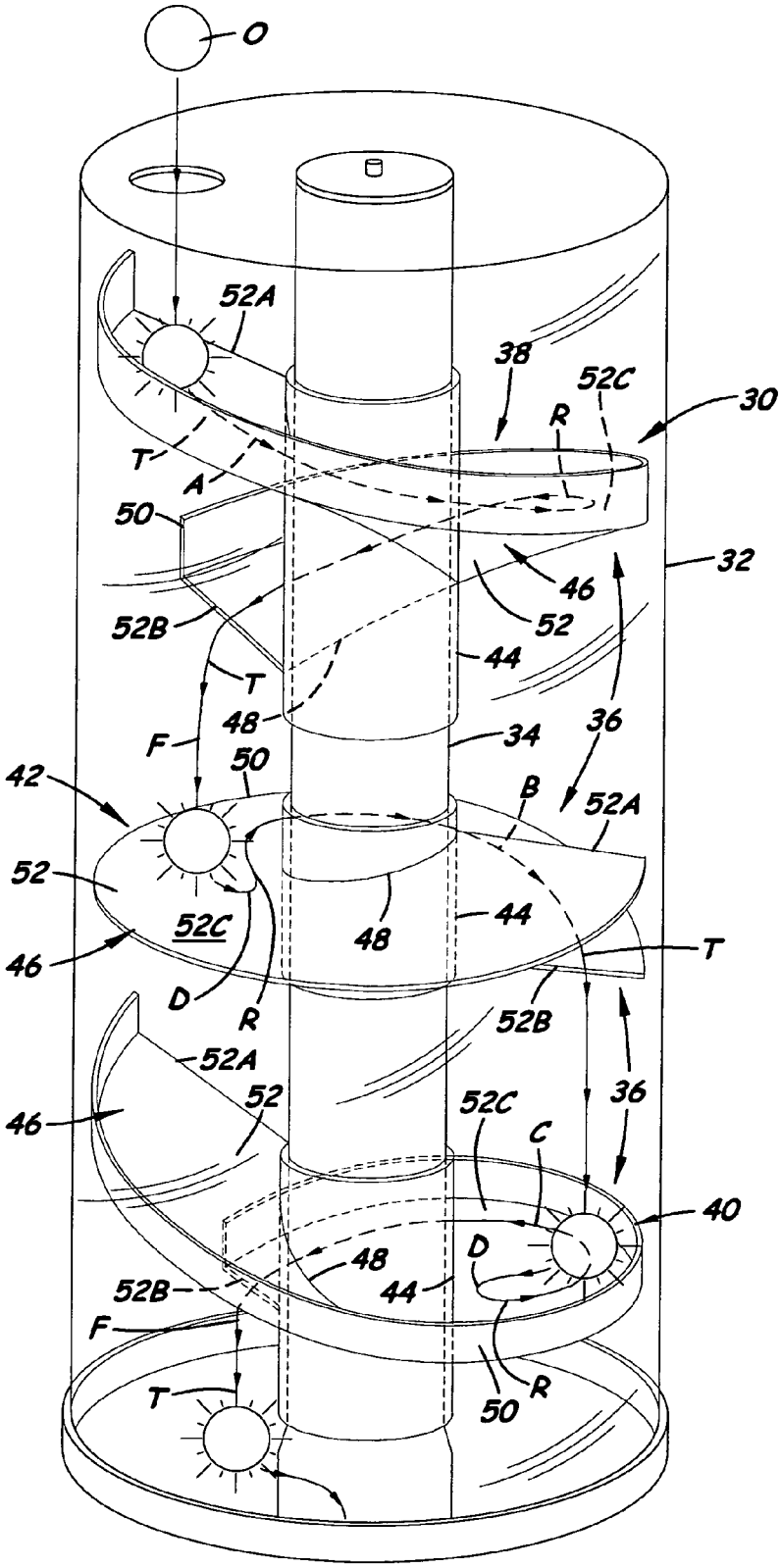
FIG. 3 is an enlarged fragmentary perspective view of the product transfer assembly of FIG. 2.

Referring now to FIGS. 2 and 3, the product transfer assembly 30 is disposed inside of an exterior tubular enclosure 32 and employed in conjunction with a central support member 34, which can be similar to the pre-existing elongated tubular support member 18 of the vending machine 10. The exterior tubular enclosure 32 is cylindrical in configuration, made of a transparent material and extends between the modified housing 14 and base 20 of the vending machine. The central support member 34 is preferably disposed in a generally upright orientation.

The product transfer assembly 30 basically includes a plurality of separate product transfer segments 36 adapted to be mounted in the vending machine 10 along the central support member 34 such that the transfer segments 36 are disposed in a spaced apart relationship above one another. In the illustrated exemplary embodiment, the plurality of transfer segments 36 are three in number and arranged such that there is an upper transfer segment 38, a lower transfer segment 40 and a middle transfer segment 42 disposed between the upper and lower transfer segments 38, 40 and spaced a short distance from each of them. However, the three transfer segments 38, 40, 42 are similar to one another in that each includes a hollow tubular member 44 and a ramp 46. Each hollow tubular member 44 is substantially shorter in length than the upright central support member 34 and is installed over the central support member 34 in a close-fitting relationship therewith so as to remain at a desired installed position along the central support member 34 in which the tubular members 44 are spaced apart from each other along the central support member 34 above and below one another.

Each ramp 46 has a helical shape and opposite inner and outer arcuate-shaped edge portions 48, 50. The inner edge portion 48 is fixedly attached to and extends about the tubular member 44 so as to define a juncture therewith having a substantially helical configuration. The ramp 46 also has a floor 52 extending between and along the opposite inner and outer edge portions 48, 50 and terminating at them. The floor 52, similar in shape to a flight of an auger, has a substantially helical shape and is provided with opposite entrance and exit ends 52A, 52B. The entrance end 52A is spaced substantially above the exit end 52B. Both entrance and exit ends 52A, 52B are located substantially adjacent to the same side of the central support member 34. The outer edge portion 50 is a ledge fixedly attached to and extending above the floor 52.

The transfer segments 38, 40, 42 are arranged with respect to one another such that with one transfer segment disposed above or below another transfer segment the entrance and exit ends 52A, 52B of the floor 52 of each transfer segment are angularly displaced from the entrance and exit ends 52A, 52B of the floor 52 of an adjacent transfer segment such that a product item O traveling, such as by sliding or rolling, down the upper transfer segment 38 will leave its exit end 52B, free-fall downwardly through a steep trajectory and land onto an intermediate area 52C of the floor 52 of the middle transfer segment 42, which intermediate area 52C is spaced about the same distance from both entrance and exit ends 52A, 52B of the floor 52 of the middle transfer segment 42. The same is repeated by the object O in its travel between the middle transfer segment 42 and the lower transfer segment 40 except that the direction of travel of the product item O down the ramp 46 of the middle transfer segment 42 is the reverse of its direction of travel down the upper and lower transfer segments 38, 40.

Figure 4:
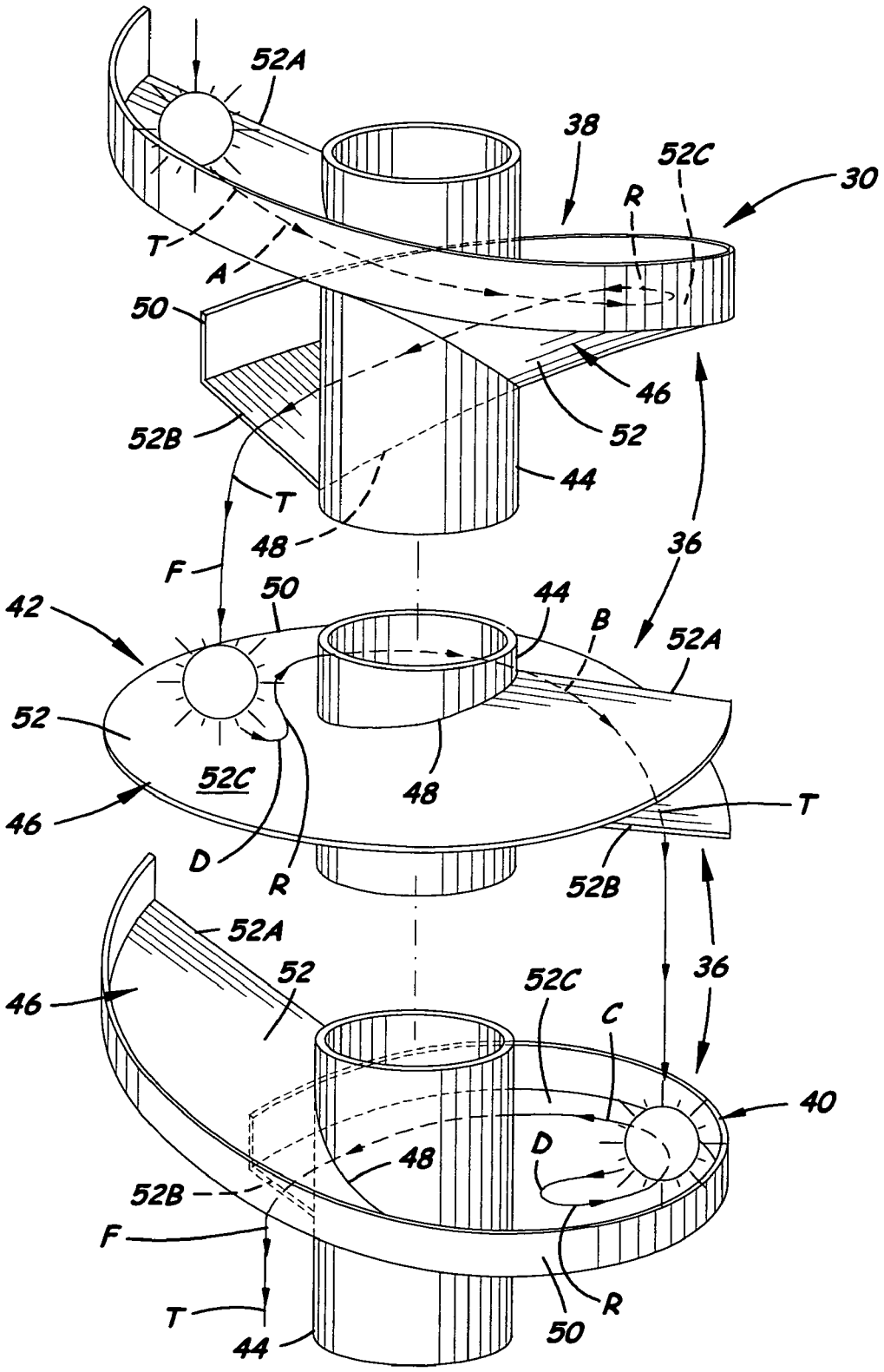
FIG. 4 is a perspective view similar to that of FIG. 3 but now showing only the arrangement of the three transfer segments of the transfer assembly as they are seen in FIG. 3.

More particularly, as best seen in FIG. 4, the ramps 46 of the upper and lower transfer segments 38, 40 have similar substantially helical configurations that cause the product item O to travel or move down them in the same direction, such as a counterclockwise direction. By contrast thereto, the ramp 46 of the middle transfer segment 42 too has a substantially helical configuration but it is opposite in its orientation to the helical configurations of the upper and lower transfer segments 38, 40 such that the product item O travels in a second direction, such as a clockwise direction, opposite to the first, counterclockwise direction and thereby describes a modified zigzag path of travel T of the product item O down the transfer assembly 30, as seen in FIGS. 3-5.

Figure 5:
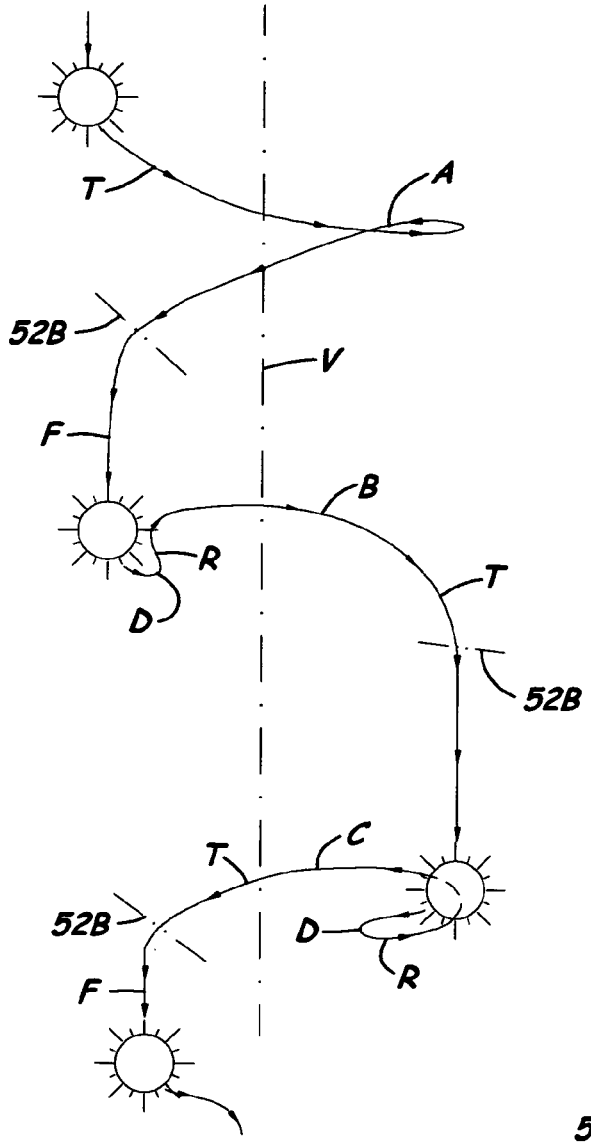
FIG. 5 is a diagrammatical view showing only the path of travel that the product item takes traveling down the transfer assembly of FIG. 3.
Figure 6:
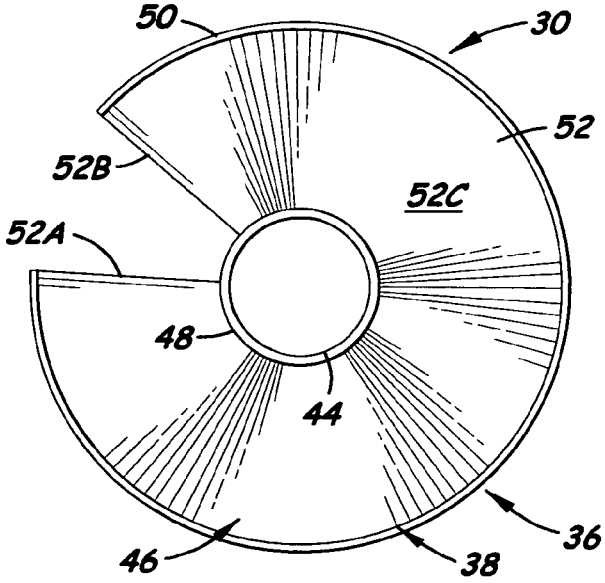
FIG. 6 is a top plan view of the upper transfer segment of the transfer assembly of FIG. 4.

Thus, as best seen in FIGS. 4 and 5, the ramps 46 define a path of travel T taken by the product item O downward and in contact with the ramps 46 which path T includes a plurality of spaced apart portions A, B, C, each substantially helical in shape and together reversing the direction of travel of the product item O relative to a generally vertical reference axis V going from one portion to the next portion of the path T. Furthermore, the entrance and exit ends 52A, 52B of each ramp 46 are angularly displaced from the entrance and exit ends 52A, 52B of an adjacent ramp 46 such that the product item O will leave the exit end 52B of an upper one of the transfer segments, free-fall along a descending trajectory out of contact with the ramps 46 of any transfer segment and land on the intermediate area 52C of the ramp 46 of a next lower one of the transfer segments which is spaced from and disposed between the entrance and exit ends 52A, 52B thereof such that the product item O will slow by traveling a short distance up the ramp 46 of that transfer segment, as represented by a path fragment R and make a turn at D while in contact with the intermediate area 52C of the ramp 46 of that transfer segment in order to reverse the direction of travel of the product item O relative to the generally vertical reference axis V The momentum of the product item O upon leaving the exit ends 52B of the ramps 46 of the respective upper and middle transfer segments 38, 42 is sufficient to cause the product item O to initially move up the intermediate areas 52C of the ramps 46 along the path fragment R before slowing and then reversing direction at D and then traveling down the ramps 46. In such manner, a product item O is caused to move down in a modified zigzag shaped path of travel T made of the portions A, B, C in which the product item O is in contact with the ramps 46 of the transfer segments 36 and during other alternating portions F in which the object O is in free-fall out of contact with the ramps 46 of the transfer segments 36 such that such motion will advantageously add an entertainment aspect to the vending machine 10 incorporating the product transfer assembly 30 of the present invention which will attract the attention of consumers to it.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereto.

The invention claimed is:

1. A product transfer assembly for use in a machine for vending products, said transfer assembly comprising:

(a) a central support member adapted to be supported in a generally upright orientation; and (b) a plurality of separate transfer segments mounted along and about said central support member such that said transfer segments are disposed in a spaced relationship above and below one another, each of said transfer segments including a ramp of substantially helical shape with opposite entrance and exit ends, said entrance and exit ends being spaced substantially above and below one another and substantially adjacent to the same side of said central support member, said ramps of adjacent ones of said transfer segments being of opposite helical shapes such that said ramps together define a path of travel taken by an item of product downward and in contact with said ramps which path includes a plurality of spaced apart portions substantially helical in shape and reversing the direction of travel of the product item, relative to a generally vertical reference axis, going from one portion to the next portion of said path.

2. The product transfer assembly of claim 1, wherein said entrance and exit ends of each ramp are angularly displaced from said entrance and exit ends of an adjacent ramp such that the product item will leave said exit end of an upper one of said transfer segments, free-fall along a descending trajectory out of contact with said ramps of any transfer segments and land on an intermediate area of said ramp of a next lower one of said transfer segments which intermediate area is spaced from and disposed between said entrance and exit ends of said ramp of said next lower transfer segment such that the product item will slow by traveling a short distance up said ramp and make a turn while in contact with said intermediate area of said ramp in order to reverse the direction of travel of the product item relative to said generally vertical reference axis.

3. The product transfer assembly of claim 1 wherein each of said transfer segments also includes a tubular member fixedly attached to an inner side of said ramp of said transfer segment and, in turn, installed about said central support member such that said tubular members and thereby said transfer segments are disposed along said central support member above and below one another.

4. The product transfer assembly of claim 3 wherein said ramp of each of said transfer segments has opposite inner and outer arcuate-shaped edge portions, said inner edge portion being fixedly attached to and extending about a corresponding one of said tubular members so as to define a juncture therewith having a substantially helical configuration.

5. The product transfer assembly of claim 4 wherein said ramp of each of said transfer segments also has a floor extending between said opposite inner and outer edge portions and having said substantially helical shape.

6. The product transfer assembly of claim 5 wherein said outer edge portion of at least some of said ramps of said transfer segments is a ledge fixedly attached to and extending above said floor.

7. A product transfer assembly for use in a machine for vending products, said transfer assembly comprising:

(a) a central support member adapted to be supported in a generally upright orientation; and (b) a plurality of transfer segments spaced apart from each other and mounted along said central support member, each of said transfer segments including (i) a tubular member substantially shorter in length than said central support member and installed over said central support member in a close-fitting relationship therewith so as to remain at a desired installed position along said central support member in which said tubular members of said plurality of transfer segments are spaced apart from each other along said central support member above and below one another, and (ii) a ramp having a substantially helical shape and opposite inner and outer arcuate-shaped edge portions, said inner edge portion being fixedly attached to and extending about said tubular member so as to define a juncture therewith having a helical configuration, said ramp also having a floor extending between said opposite inner and outer edge portions and also having a substantially helical shape with opposite entrance and exit ends, said entrance and exit ends being spaced substantially above and below one another and substantially adjacent to the same side of said central support member, said outer edge portion being a ledge fixedly attached to and extending above said floor;

(c) said plurality of transfer segments being arranged with respect to one another such that one of said transfer segments is disposed above another of said transfer segments and said entrance and exit ends of each ramp floor are angularly displaced from said entrance and exit ends of a ramp floor of an adjacent transfer segment such that an item of product traveling down an upper one of said transfer segments will leave its exit end, free-fall downward and land onto an intermediate area of said ramp floor of a lower one of said transfer segments spaced from both said entrance and exit ends of said lower transfer segment.

8. The product transfer assembly of claim 7 wherein said outer edge portion of said ramp floor of at least some of said transfer segments is a ledge fixedly attached to and extending above said floor.

9. A product transfer assembly for use in a machine for vending products, said transfer assembly comprising:

(a) a central support member adapted to be supported in a generally upright orientation;

(b) an outer enclosure disposed in spaced relationship about and outwardly from said central support member; and (c) a plurality of transfer segments disposed in a spaced relationship above and below one another and mounted along said central support member and extending outwardly therefrom to adjacent to said outer enclosure so as to substantially occupy the space between said central support member and said outer enclosure, each of said transfer segments including (i) a tubular member substantially shorter in length than said central support member and installed over said central support member in a close-fitting relationship therewith so as to remain at a desired installed position along said central support member in which said tubular members are disposed along said central support member above and below one another, and (ii) a ramp having a substantially helical shape and opposite inner and outer arcuate-shaped edge portions, said inner edge portion being fixedly attached to and extending about said tubular member so as to define a juncture therewith having a helical configuration, said ramp also having a floor extending between said opposite inner and outer edge portions and being formed in said helical shape with opposite entrance and exit ends, said entrance and exit ends being spaced substantially above and below one another and substantially adjacent to the same side of said central support member, said outer edge portion on at least some of said ramp floors being a ledge fixedly attached to and extending above said floor and disposed along said outer enclosure.

* * * * *